US010214873B2

(12) United States Patent
Meier et al.

(10) Patent No.: US 10,214,873 B2
(45) Date of Patent: Feb. 26, 2019

(54) VALVE UNIT FOR A QUICK-CHANGER AND QUICK-CHANGE SYSTEM

(71) Applicant: Liebherr-Hydraulikbagger GmbH, Kirchdorf/Iller (DE)

(72) Inventors: Simon Meier, Amendingen (DE); Thomas Zitterbart, Dietenheim (DE)

(73) Assignee: Liebherr-Hydraulikbagger GmbH, Kirchdorf/Iller (DE)

( * ) Notice: Subject to any disclaimer, the term of this patent is extended or adjusted under 35 U.S.C. 154(b) by 141 days.

(21) Appl. No.: 15/371,287

(22) Filed: Dec. 7, 2016

(65) Prior Publication Data

US 2017/0159263 A1 Jun. 8, 2017

(30) Foreign Application Priority Data

Dec. 7, 2015 (DE) ..... 10 2015 015 809

(51) Int. Cl.

| | |
|---|---|
| ***E02F 3/36*** | (2006.01) |
| ***E02F 3/38*** | (2006.01) |
| *E02F 9/22* | (2006.01) |
| *F15B 1/02* | (2006.01) |

(52) U.S. Cl.

CPC ..... *E02F 3/3663* (2013.01); *E02F 3/369* (2013.01); *E02F 3/3686* (2013.01); *E02F 3/382* (2013.01); *E02F 9/2217* (2013.01); *F15B 1/022* (2013.01); *F15B 2211/212* (2013.01); *F15B 2211/30515* (2013.01); *F15B 2211/30565* (2013.01); *F15B 2211/40507* (2013.01); *F15B 2211/41509* (2013.01); *F15B 2211/50554* (2013.01); *F15B 2211/50563* (2013.01); *F15B 2211/5151* (2013.01); *F15B 2211/5153* (2013.01); *F15B 2211/8633* (2013.01)

(58) Field of Classification Search

CPC . F15B 13/04; E02F 3/382; E02F 3/369; E02F 3/3663; E02F 3/3609

See application file for complete search history.

(56) References Cited

U.S. PATENT DOCUMENTS

| | | | | |
|---|---|---|---|---|
| 7,426,796 | B2 * | 9/2008 | Cunningham | E02F 3/3618 37/234 |
| 2014/0030005 | A1 * | 1/2014 | Friedrich | E02F 3/365 403/31 |
| 2015/0330053 | A1 * | 11/2015 | Ravindran | E02F 3/3618 29/426.5 |
| 2017/0030047 | A1 * | 2/2017 | Yokota | E02F 3/3618 |

FOREIGN PATENT DOCUMENTS

| | | | | |
|---|---|---|---|---|
| DE | 19548943 | A1 * | 7/1997 | E02F 9/2221 |
| DE | 20 2008 015 191 | U1 | 4/2009 | |
| DE | 20 2012 009 838 | U1 | 12/2013 | |
| DE | 10 2014 200 469 | A1 | 7/2015 | |

* cited by examiner

*Primary Examiner* — Thomas E Lazo
(74) *Attorney, Agent, or Firm* — Dilworth & Barrese, LLP

(57) ABSTRACT

The invention relates to a valve unit for the exclusive hydraulic actuation of the locking means of a mechanical quick-changer for attachments of a construction machine, wherein the valve unit comprises a feed pressure connector for applying the feed pressure, a first valve unit outlet for connecting an unlocking pressure line, a second valve unit outlet for connecting a locking pressure line, at least one discharge to the tank, and at least two switchable directional valves, with the feed pressure connector being connected or connectable to the second valve unit outlet via a serial connection of the at least two switchable directional valves.

19 Claims, 2 Drawing Sheets

VALVE UNIT FOR A QUICK-CHANGER AND QUICK-CHANGE SYSTEM

BACKGROUND OF THE INVENTION

The invention relates to a valve unit for the hydraulic actuation of the locking means of a mechanical quick-changer for attachments of a construction machine as well as to a quick-change system having such a valve unit and having a quick-change adapter Quick-change systems serve to allow attachment tools of a construction machine to be changed fast and without complications. This requires a fast connection of both mechanical and hydraulic connections between the attachment tool and the construction machine, in particular the boom system of the machine. So-called quick-change adapters which can be assembled at the construction machine side as required and which include the required components for the fast establishing of a connection to the attachment tool are becoming more and more popular. The mechanical securing of the attachment tool at the adapter is achieved via a locking means of the adapter. A hydraulically actuable bolt mechanism is frequently made use of in this respect whose bolt(s) can be actuated by one or more hydraulic cylinders and can thereby automatically be plugged into the associated bolt receivers at the attachment tool.

The quick-change adapter has to be supplied with hydraulic fluid from a quick-change circuit of the construction machine for the actuation of the locking means or of the hydraulic cylinder respectively. An example for the interconnection of a conventional quick-change circuit can be seen from FIG. 1. The quick-change adapter 5 comprises the said locking means in the form of a hydraulic cylinder 6 whose piston rod actuates, via a coupling mechanism, the they are is plugged, i.e. the attachment tool is locked, and when the piston rod is retracted, the locking bolts are pulled and the attachment tool is unlocked.

The quick-change adapter 5 can be releasably installed at the construction machine, preferably at its boom system. The hydraulic supply of the hydraulic cylinder 6 takes place from the superstructure of the construction machine, for which purpose connectors for the locking and unlocking pressure lines are provided at the adapter 5. The locking and unlocking pressure lines are connected in the adapter itself via directional valves 2, 3 to the piston chamber or ring chamber of the cylinder 6 to trigger the locking/unlocking by a directional valve. The hydraulic supply in the superstructure provides a central 4/3-way directional valve 1 by which a pressure supply for the quick-change adapter 5 and also for further consumers such as the gripper control 4 is provided and controlled. The 4/3-way directional valve 1 for executing specific work procedures is consequently designed with a middle blocking position so that the gripper movement can be blocked. Making use of a central directional valve 1 used for a plurality of consumers requires the integration of the control valves 2, 3 in the quick-change adapter 5; the design of the quick-change adapter thus becomes incomparably more complex. However, this actually makes the operation of the quick-change adapter 5 more difficult at third-party devices, i.e. at construction machines of other manufacturers.

In addition to an improved attachment possibility at third-party devices, it is also desirable to increase the safety level of the quick-change system comprising an adapter and a hydraulic supply since such systems can represent a high risk potential for life and limb of people due to their purpose on a malfunction. The safety-specific focus of corresponding controls has previously primarily been on the electronics or on the operation and consequently on the electrical control or on the position monitoring of the corresponding locking/unlocking valve. This has had the result that sufficient measures were admittedly taken against an unintentional unlocking or actuation by the machine operator, but a single failure or a malfunction of any hydraulic components, e.g. of the locking or unlocking valves, for instance, remained out of consideration in previous studies and developments. However, the malfunction of a single valve can already result in the locking and releasing of the attachment tool in operation.

SUMMARY OF THE INVENTION

It is the object of the present invention for this reason to further develop a quick-change of the category such that hydraulic safety measures are also taken in addition to current safety precautions.

This object is achieved by a valve unit for the hydraulic actuation of the locking means of a mechanical quick-changer for attachments of a construction machine in accordance with the features herein. Advantageous embodiments of the valve unit are the subject of the description herein.

In accordance with the invention, a valve unit is proposed which only serves the hydraulic actuation of the locking means of a mechanical quick-change adapter for attachments. A separate hydraulic configuration for the control of the quick-change adapter is thus provided by means of the valve unit. The valve unit, which can be directly connected to a supply line, thus only serves the switching/control and thus the pressure supply of the quick-change adapter. Other consumers can deliberately no longer be connected.

For this purpose, the valve unit comprises a feed pressure connector for applying a feed pressure. In addition, a first and second valve unit outlet are provided, with the first valve unit outlet serving the connection of an unlocking pressure line, while the second valve unit outlet is provided for the connection of a locking pressure line. The valve unit thus only comprises these two valve outlets for the control of the quick-change adapter; further outlets for the control of any different hydraulic components deliberately do not exist. At least one discharge to the tank is furthermore provided.

The construction of the valve unit tailored to the quick-change adapter allows a greatly simplified design of the adapter itself since the separate directional valves for the unlocking and locking pressure lines can in particular be omitted without replacement. The compatibility of the quick-change adapter with third-party devices is improved.

To increase the operating safety of the quick-change system, the valve unit additionally comprises at least two switchable directional valves, with the feed pressure connector being connected or connectable to the first valve unit outlet via a serial connection of the at least two switchable directional valves. The first valve unit outlet serves the control of the safety-critical unlocking pressure line. The interconnection of the at least two directional valves in series thereby requires a corresponding switch position of both directional valves to provide the required pressure level at the unlocking pressure line. The unlocking of the attachment tool is not a direct consequence of the malfunction of a directional valve; the system rather remains in a safe, locked state.

Since only the unlocking outlet line represents the safety-critical aspect of the total system, it is preferably sufficient for the second valve unit outlet for the locking pressure only to be connectable to the feed pressure connector via a directional valve. The switching process of a directional valve is sufficient for the locking of the attachment tool.

The two directional valves can, for example, be electrically actuable, with ideally two separate control channels being provided for controlling the directional valves. It is likewise conceivable that both directional valves are of different construction types, for example in the form of at least one gate valve as well as of at least one poppet valve. Due to the difference and the separate electrical control of the directional valves in the system, they are diverse from one another, whereby a simultaneous failure or malfunction of both valves as a consequence of a common cause is precluded. However, this does not preclude the use of valve types of the same construction so that the key idea of the invention can likewise be achieved with redundant valves.

It is conceivable for the valve unit to comprise at least one integrated pressure store and/or to comprise a separate connector for an external pressure store. A loss of the feed pressure on the failure of the hydraulic pump can, for example, be compensated by the integration of the pressure store so that at least a sufficient pressure level on the locking line can be ensured and the attachment tool remains in the safe, locked state.

In a particularly preferred embodiment, the first directional valve is configured with two switching states, with the first switching state connecting the feed pressure connector of the valve unit to the second directional valve and the second switching state connecting the feed pressure connector to the second valve unit outlet. Accordingly, either the unlocking process or the locking process can be initiated via the first directional valve. It is additionally conceivable in the second switching state of the first directional valve that the second directional valve is connected to the tank via the first directional valve. A volume backflow to the tank can thereby be ensured on the unlocking line.

An equipping of the second directional valve with two switching states is likewise conceivable in order selectively to release or to block the connection of the first directional valve to the first valve unit outlet. The volume flow from the first directional valve to the first valve unit outlet is, for example, released in a first switching state. The second switching state blocks the volume flow from the first directional valve to the first valve unit outlet. It is, however, better if the volume flow is only blocked in one direction, i.e. from the first directional valve to the first valve unit outlet, in this second switching state and a backflow from the first valve unit outlet to the tank via the second directional valve and, optionally, via the first directional valve remains possible.

It is conceivable that both directional valves are designed such that there is a connection of the feed pressure inlet to the second valve unit outlet in the currentless state or in the non-controlled state; both directional valves are in particular preloaded and each switch into the second switching position in the currentless state. On the failure of the electronics, a safe state of the total system is adopted in that the locking element of the quick-change adapter remains or is brought into the locked position.

A monitoring of the valve unit or of the total system is moreover expedient. The valve unit in particular provides one or more pressure sensors or connector points for the connection of external pressure sensors for this purpose. The connection of the pressure sensors is sensible in the region of the system pressure, i.e. either at the feed pressure inlet or at a measurement point just before the first directional valve. Further measuring points are favorable, for example, in the region of the first and/or second valve unit outlets for the unlocking line and/or for the locking line.

In addition to the valve unit in accordance with the invention, the present invention relates to a quick-change system having at least one quick-change adapter for the installation of an attachment and having at least one valve unit in accordance with the present invention. The same advantages and properties such as have already been described with reference to the valve unit in accordance with the invention thus obviously result for the quick-change system in accordance with the invention. A repeat description is not considered as necessary for this purpose.

In a preferred embodiment of the quick-change system, the quick-change adapter comprises a locking means, in particular at least one hydraulic cylinder, and connectors for a locking pressure line and for an unlocking pressure line for actuating the corresponding cylinder chambers of the hydraulic cylinder. It is furthermore expedient that the locking pressure line is connected to the locking means via at least one check valve, preferably via at least one controllable check valve for the release as required of a volume pressure backflow from the locking means in the direction of the connector of the locking pressure line. The at least one check valve is ideally hydraulically controlled, with a pressure branch from the unlocking pressure line being used as the hydraulic control pressure.

In addition to the quick-change system in accordance with the invention, the present invention likewise relates to a construction machine, in particular to a hydraulic excavator, having at least one valve unit in accordance with the present invention or having a quick-change system in accordance with the present invention. The valve unit is preferably integrated into the superstructure and the quick-change adapter is releasably connectable to the construction machine, preferably to a boom system of the construction machine. The valve unit can alternatively also be integrated in the quick-change adapter.

BRIEF DESCRIPTION OF THE DRAWINGS

Further advantages and properties of the invention will be explained in detail in the following with reference to an embodiment shown in the drawing. There are shown.

DESCRIPTION OF THE PREFERRED EMBODIMENTS

Figure 1:
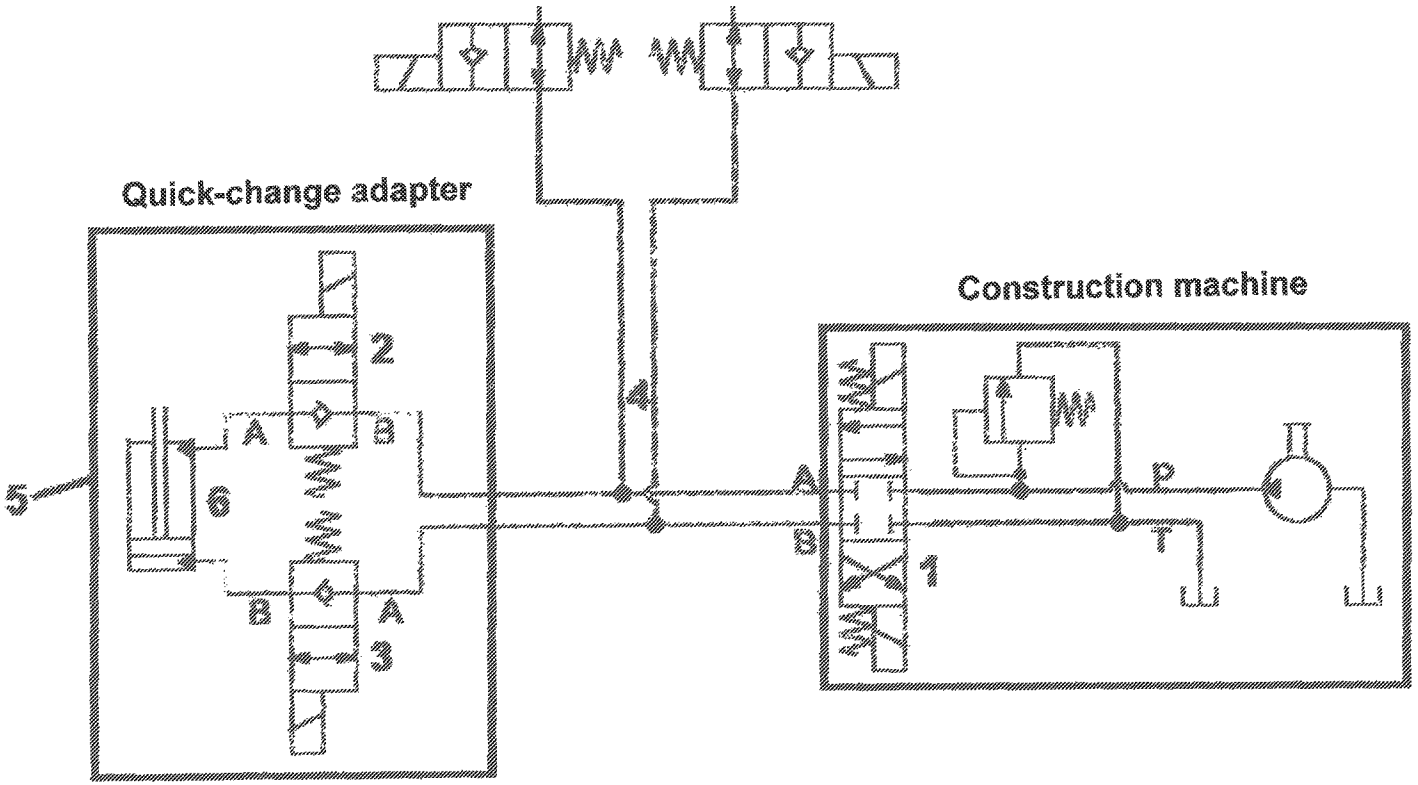
Fig. 1 Prior Art
FIG. 1: a hydraulic control of a quick-change adapter in accordance with the prior art.

The conventional design of a quick-change adapter or of the hydraulic circuit required for it in accordance with FIG. 1 was explained in detail at the beginning during the discussion of the prior art.

Figure 2:
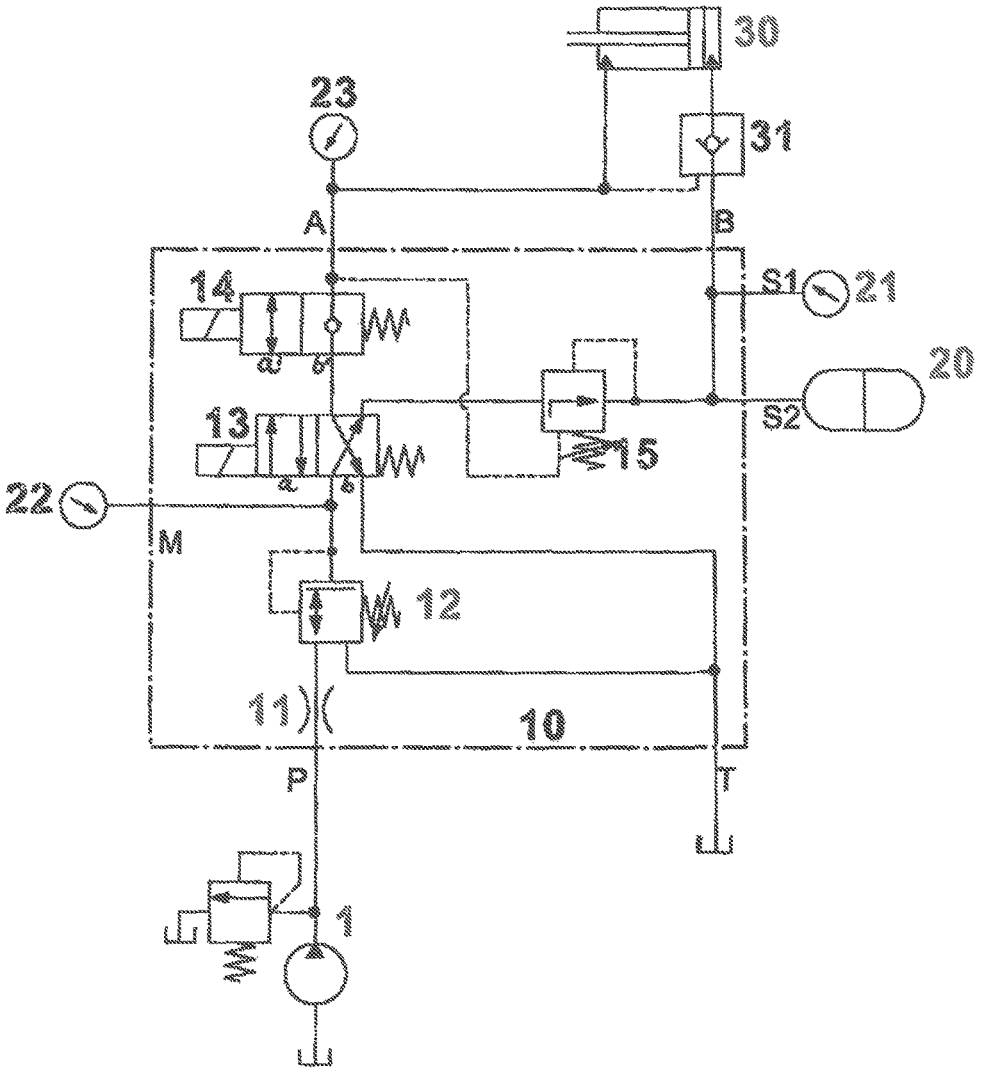
FIG. 2: a hydraulic circuit diagram of the valve unit in accordance with the invention with a connected quick-change adapter.

FIG. 2 shows a hydraulic circuit diagram of the valve unit 10 in accordance with the invention. The valve unit 10 comprises a feed pressure inlet P as well as the two valve unit outlets A, B to which a likewise modified quick-change adapter can be connected. The valve unit 10 is only configured for the control and pressure supply of the quick-change adapter; for safety reasons, no further consumers should be controlled or fed by the valve unit 10.

A restrictor 11 is provided at the inlet side in combination with the pressure-reducing valve 12 to be able to connect the valve unit 10 directly to the system pressure P of the construction machine. The system pressure P of the construction machine can thereby be restricted and regulated to the system pressure M within the valve unit 10 required for the operation of the quick-change adapter. The pressure-reducing valve 12 in particular allows a variable setting of the system pressure M.

The valve unit outlet A serves the connection of an unlocking pressure line of the quick-change adapter, while the valve unit outlet B is intended for the connection of the locking pressure line. The constructionally simplified quick-change adapter is connected to these two connector points A, B and is made up of a hydraulic cylinder 30 for actuating a locking means and of the check valve 31. The unlocking pressure line A is connected to the rod side of the cylinder 30, while the locking pressure line B is connected to the base side. The check valve 31 in its normal position provides that no hydraulic medium can escape from the cylinder 30 at the rod side as long as no corresponding control command for the valve opening is applied at the check valve 31. The control of the check valve 31 takes place hydraulically in that a branch of the unlocking pressure line A is used as the control pressure. The connection of the valve unit in accordance with the invention can also take place in the reverse order.

To achieve a certain redundancy or diversity in the hydraulic control of the quick-change adapter, the valve unit 10 is equipped with two directional valves 13, 14 which are electrically actuable via separate control channels. The first valve 13 is a 4/2-way directional valve and is connected at the inlet side to the outlet of the pressure-reducing valve 12, i.e. the system pressure M is applied to the inlet of the valve 13. The two switching states a, b of the directional valve 13 allow a connection of the system pressure M either to the valve inlet of the second directional valve 14 and thus indirectly to the unlocking pressure line A (switching state a) or alternatively to the valve unit outlet B for attaching to the locking pressure line (switching state b). The second directional valve which is designed as a 2/2-way directional valve therefore comprises two switching states a', b', with the outlet of the directional valve 13 being connected to the valve unit outlet A in a switching state a'. In the second switching state b', the valve 14 only blocks the volume flow from the valve 13 to the valve unit outlet A; a backflow from the valve unit outlet A to the valve 13 is released, however.

Both directional valves 13, 14 comprise a pilot valve having an electromagnetic actuation against spring pre-load so that if the electromagnet is not actuated both directional valves 13 14, remain, as shown in FIG. 2, in the second switching position b, b' or are switched into this state. In this valve state, the system pressure M is applied to the valve unit outlet B for the locking pressure line to ensure a sufficient pressure level for the maintenance of the locking position of the hydraulic cylinder 30. In this state, the unlocking pressure line A is connected to the directional valve 13 via the directional valve 14, with the directional valve 13 ensuring a backflow of the unlocking pressure line A into the hydraulic tank T. It is thus sufficient for the locking actuation of the quick-change adapter to switch the directional valve 13 into the second switching state b.

The system pressure M is also applied to the directional valve 14 in the first switching state a of the first directional valve 13. If the directional valve 14 is likewise in the first switching state a, the system pressure M is applied via both directional valves 13, 14 at the valve unit outlet A for the unlocking pressure and the quick-change adapter is unlocked by a pressurization of the ring chamber of the hydraulic cylinder 30.

For technical safety reasons, a pressure shut-off valve 15 is additionally integrated between the directional valve 13 and the outlet of the locking pressure line B and interrupts the connection between the directional valve 13 and the outlet B if the pressure level of the locking pressure line B exceeds a specific limit value. In this case, the pressure of the locking pressure line B in conjunction with the adjustable pre-load of the spring of the pressure shut-off valve 15 serves as the limit value.

Otherwise the flow from the directional valve 13 to the outlet B should be opened by the pressure shut-off valve 15 when the pressure level at the first valve unit outlet A exceeds a limit value. This is also necessary in order not to cause any pressure buildup when an unlocking is initiated. In this constellation, the pressure shut-off valve 15 acts redundantly with respect to the check valve 31 of the quick-change adapter.

In addition, the valve unit 10 can comprise a pressure store 20 in order, on a failure of the hydraulic pump 1, to be able to compensate the drop thereby caused in the system pressure M so that the hydraulic cylinder 30 remains in the locked position. Possible pressure sensors 21, 22, 23 or measurement points can be integrated in the valve unit 10 for monitoring purposes, for instance, e.g. in the region of the system pressure M and also in the region of the unlocking pressure line A and the locking pressure line B.

With respect to the design of the quick-change system in accordance with FIG. 1, the two valves 2, 3 shown there in the quick-change adapter can be dispensed with and only a check valve 31 can be attached to the locking pressure line B. For this purpose, the valve unit 10 is transposed in the superstructure of the construction machine, whereby more advantages arise with respect to the locking security and universal function of the quick-change adapter.

The control valves 13, 14 used in the proposed valve unit 10 are configured as a gate valve (valve 13) and as a poppet valve (valve 14). A diversity in the valve arrangement results due to the different construction type and to the control of the two valves 13, 14 via separate channels. A simultaneous failure or a simultaneous malfunction of both valves 13, 14 as a result of a common cause (design error, etc.) is thereby precluded.

These valves 13, 14 connected in series are furthermore designed such that when the quick-changer is locked, the pressure medium can only be sufficiently controlled with the aid of the valve 13. On the unlocking, in contrast, both valves 13, 14 have to be moved into the position required for this purpose, i.e. into the first switching position a, a'. After the locking of the quick-change adapter, the valve 13 remains in the second switching position b, whereby the pressurization on the locking side (base side) of the cylinder 30 is still maintained and an unlocking can therefore not take place, not even if the valve 14 should stick in switching position a' (unlock) or if it is jammed in this switching position. The locking system of the quick-change system is thus not only diverse, but also redundant.

The locking redundancy in this respect results in this regard both from the interconnection of the control valves 13, 14 and from the positioning of the pressure restriction vale 15 which acts redundantly with respect to the check valve 31. The system is additionally still failsafe due to the fact that the system automatically switches into the safe state (locked) in the event of a defect. This is e.g. the case when a problem arises in the electrical system. In this case, the switching valves 13 and 14 would be switched into the currentless states (second switching positions b, b') due to the pre-load and the safe state (locked) would automatically be brought about.

In summary, the disclosed valve arrangement 10 allows a redundant, diverse and also accident-proof interconnection of the quick-change adapter.

The invention claimed is:

1. A valve unit for the exclusive hydraulic actuation of the locking means of a mechanical quick-changer for attachments of a construction machine, wherein the valve unit comprises a feed pressure connector, a first valve unit outlet for connecting an unlocking pressure line, a second valve unit outlet for connecting a locking pressure line, at least one discharge to the tank, and at least two switchable directional valves, with the feed pressure connector being connected or connectable to the first valve unit outlet via a serial connection of the at least two switchable directional valves, and the valve unit comprises an integrated pressure store and/or a separate store connector for an external pressure store, with the internal pressure store and/or the external pressure store connector being connected or connectable to the second valve unit outlet.

2. A valve unit in accordance with claim 1, wherein the second valve unit outlet can only be connected to the feed pressure connector via a directional valve.

3. A valve unit in accordance with claim 1, wherein a pressure-reducing valve is provided at the feed pressure connector.

4. A valve unit in accordance with claim 1, wherein the at least two directional valves are electrically actuable.

5. A valve unit in accordance with claim 4, wherein the at least two directional valves are controllable via two separate control channels.

6. A valve unit in accordance with claim 1, wherein the at least two directional valves are different valve types.

7. A valve unit in accordance with claim 6, wherein the at least two directional valves include a poppet valve and a gate valve.

8. A valve unit in accordance with claim 1, wherein both directional valves are switched in the currentless state such that a connection of the feed pressure connector to the second valve unit outlet is present, both directional valves are in particular preloaded and switch into the second switching position in the currentless state.

9. A valve unit in accordance with claim 1, wherein the valve unit comprises one or more pressure sensors or connectors for external pressure sensors, with pressure sensors or connector points being provided for detecting the system pressure and/or the pressure at the first and/or second valve unit outlets.

10. A quick-change system having at least one quick-change adapter for installing an attachment and having at least one valve unit in accordance with claim 1.

11. A quick-change system in accordance with claim 10, wherein the quick-change adapter comprises a locking means and connectors for a locking pressure line and an unlocking pressure line, with the locking pressure connector being connected to the locking means via at least one check valve.

12. A quick-change system in accordance with claim 11, wherein the locking means include at least one hydraulic cylinder and the check valve is controllable for the release as required of a volume pressure backflow from the locking means.

13. A quick-change system in accordance with claim 12, wherein the check valve is hydraulically controlled with a hydraulic control line connected to the unlocking pressure line.

14. A construction machine having at least one valve unit in accordance with claim 1, wherein the valve unit is integrated in a superstructure of the construction machine.

15. The construction machine in accordance with claim 14, which is a hydraulic excavator.

16. A valve unit for the exclusive hydraulic actuation of the locking means of a mechanical quick-changer for attachments of a construction machine, wherein the valve unit comprises a feed pressure connector, a first valve unit outlet for connecting an unlocking pressure line, a second valve unit outlet for connecting a locking pressure line, at least one discharge to the tank, and at least two switchable directional valves, with the feed pressure connector being connected or connectable to the first valve unit outlet via a serial connection of the at least two switchable directional valves, and a first directional valve comprises two switching states, with the first switching state connecting the feed pressure connector of the valve unit to the second directional valve and the second switching state connecting the feed pressure connector to the second valve unit outlet.

17. A valve unit in accordance with claim 16, wherein the second directional valve comprises two switching states to release the connection of the first directional valve to the first valve unit outlet in a first switching state or to block it in a second switching state, ideally to block it in the direction of flow of the first valve unit outlet, such that a backflow from the first valve unit outlet via the second directional valve, and optionally the first directional valve, into the tank is possible, with the second directional valve preferably being connected to the tank via the first directional valve in the second switching state.

18. A valve unit for the exclusive hydraulic actuation of the locking means of a mechanical quick-changer for attachments of a construction machine, wherein the valve unit comprises a feed pressure connector, a first valve unit outlet for connecting an unlocking pressure line, a second valve unit outlet for connecting a locking pressure line, at least one discharge to the tank, and at least two switchable directional valves, with the feed pressure connector being connected or connectable to the first valve unit outlet via a serial connection of the at least two switchable directional valves, and a pressure shut-off valve is connected between the first directional valve and the second valve unit outlet and blocks the flow from the first directional valve to the second valve unit outlet when the pressure level at the second valve unit outlet exceeds a limit pressure, with the limit pressure preferably being able to be defined by the pressure at the second valve unit outlet and/or an adjustable pressure portion.

19. A valve unit for the exclusive hydraulic actuation of the locking means of a mechanical quick-changer for attachments of a construction machine, wherein the valve unit comprises a feed pressure connector, a first valve unit outlet for connecting an unlocking pressure line, a second valve unit outlet for connecting a locking pressure line, at least one discharge to the tank, and at least two switchable directional valves, with the feed pressure connector being connected or connectable to the first valve unit outlet via a serial connection of the at least two switchable directional valves, and the pressure shut-off valve opens the flow from the first directional valve to the second valve unit outlet when the pressure level at the first valve unit outlet exceeds a limit pressure, with the limit pressure preferably being able to be defined by the pressure at the first valve unit outlet and/or an adjustable pressure portion.

* * * * *